US009624724B2

(12) United States Patent
Rodney

(10) Patent No.: US 9,624,724 B2
(45) Date of Patent: Apr. 18, 2017

(54) ACOUSTIC SIGNAL ENHANCEMENT APPARATUS, SYSTEMS, AND METHODS

(71) Applicant: Halliburton Energy Services, Inc., Houston, TX (US)

(72) Inventor: Paul F. Rodney, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/423,833

(22) PCT Filed: Nov. 20, 2012

(86) PCT No.: PCT/US2012/066077

§ 371 (c)(1),
(2) Date: Feb. 25, 2015

(87) PCT Pub. No.: WO2014/081416

PCT Pub. Date: May 30, 2014

(65) Prior Publication Data

US 2015/0337652 A1 Nov. 26, 2015

(51) Int. Cl.
*E21B 4/02* (2006.01)
*E21B 47/12* (2012.01)
(Continued)

(52) U.S. Cl.
CPC ..... *E21B 4/02* (2013.01); *E21B 17/07* (2013.01); *E21B 47/16* (2013.01); *E21B 47/18* (2013.01);
(Continued)

(58) Field of Classification Search
CPC ..... E21B 47/12; E21B 47/14; E21B 47/16; E21B 31/00; E21B 31/005; E21B 28/00; E21B 4/02; E21B 17/07; E21B 47/18
(Continued)

(56) References Cited

U.S. PATENT DOCUMENTS 3,168,049 A 2/1965 Taylor et al.
4,544,041 A 10/1985 Rinaldi
(Continued)

FOREIGN PATENT DOCUMENTS

GB 2332690 A 6/1996
RU 67177 U1 10/2007
(Continued)

OTHER PUBLICATIONS

"Australian Application Serial No. 2012394943, Notice of Acceptance mailed May 18, 2015", 2 pgs.
(Continued)

*Primary Examiner* — Hai Phan
*Assistant Examiner* — Franklin Balseca

(57) ABSTRACT

In some embodiments, an apparatus and a system, as well as a method and an article, may operate control the operation of a fluid pulse source using drilling fluid to excite vibrations in a shock sub, increasing the axial vibration in a drill string to reduce static friction between the drill string and a formation surrounding the drill string. The vibrations are excited at a fundamental frequency that is outside of the operational communications frequency range of an associated acoustic telemetry communications system. Additional apparatus, systems, and methods are disclosed.

19 Claims, 7 Drawing Sheets

(51) Int. Cl.

| | |
|---|---|
| ***E21B 47/14*** | (2006.01) |
| ***E21B 47/16*** | (2006.01) |
| ***E21B 47/18*** | (2012.01) |
| ***E21B 17/07*** | (2006.01) |
| ***E21B 28/00*** | (2006.01) |
| ***E21B 31/00*** | (2006.01) |

(52) U.S. Cl.
CPC ..... *E21B 28/00* (2013.01); *E21B 31/005* (2013.01); *E21B 47/12* (2013.01); *E21B 47/14* (2013.01)

(58) Field of Classification Search
USPC ..... 340/854.4, 854.5; 367/81, 82
See application file for complete search history.

(56) References Cited

U.S. PATENT DOCUMENTS

| | | | | |
|---|---|---|---|---|
| 4,676,725 | A | 6/1987 | Eppink | |
| 4,734,892 | A | 3/1988 | Kotlyar | |
| 4,890,682 | A | 1/1990 | Worrall et al. | |
| 5,568,448 | A | 10/1996 | Tanigushi et al. | |
| 5,836,353 | A | 11/1998 | Van Steenwyk | |
| 5,996,687 | A | 12/1999 | Pringle et al. | |
| 6,009,948 | A * | 1/2000 | Flanders | E21B 28/00 166/177.2 |
| 6,094,401 | A | 7/2000 | Masak et al. | |
| 6,279,670 | B1 | 8/2001 | Eddison et al. | |
| 6,439,318 | B1 | 8/2002 | Eddison et al. | |
| 6,508,317 | B2 | 1/2003 | Eddison et al. | |
| 7,082,078 | B2 | 7/2006 | Fripp et al. | |
| 7,082,821 | B2 | 8/2006 | Chen et al. | |
| 7,413,416 | B2 | 8/2008 | Bratu | |
| 7,870,900 | B2 | 1/2011 | Dorado | |
| 7,921,937 | B2 | 4/2011 | Brackin et al. | |
| 8,083,508 | B2 | 12/2011 | Irving et al. | |
| 2002/0148606 | A1 * | 10/2002 | Zheng | E21B 31/005 166/249 |
| 2002/0157871 | A1 | 10/2002 | Tulloch | |
| 2003/0142586 | A1 * | 7/2003 | Shah | E21B 41/0035 367/82 |
| 2003/0151977 | A1 * | 8/2003 | Shah | E21B 47/122 367/82 |
| 2005/0178558 | A1 | 8/2005 | Kolle et al. | |
| 2005/0194183 | A1 | 9/2005 | Gleitman | |
| 2005/0271535 | A1 | 12/2005 | Katz | |
| 2007/0187112 | A1 * | 8/2007 | Eddison | E21B 31/005 166/380 |
| 2007/0289778 | A1 | 12/2007 | Watkins et al. | |
| 2008/0073077 | A1 | 3/2008 | Tunc et al. | |
| 2008/0251254 | A1 * | 10/2008 | Lynde | E21B 31/005 166/301 |
| 2009/0223676 | A1 * | 9/2009 | Eddison | E21B 21/103 166/381 |
| 2010/0188253 | A1 | 7/2010 | Shearer | |
| 2010/0212900 | A1 | 8/2010 | Eddison et al. | |
| 2011/0069583 | A1 | 3/2011 | Camwell et al. | |
| 2012/0188678 | A1 | 7/2012 | Harwath et al. | |
| 2012/0305244 | A1 * | 12/2012 | Atkinson | E21B 49/081 166/264 |
| 2015/0267534 | A1 | 9/2015 | Gosney | |

FOREIGN PATENT DOCUMENTS

| | | | |
|---|---|---|---|
| WO | WO-9612893 | A1 | 5/1996 |
| WO | WO-2011058307 | A2 | 5/2011 |
| WO | WO-2014081416 | A1 | 5/2014 |
| WO | WO-2014081417 | A1 | 5/2014 |

OTHER PUBLICATIONS

"International Application Serial No. PCT/US2012/066077, Corrected International Search Report mailed May 8, 2013", 4 pgs.
"International Application Serial No. PCT/US2012/066077, Corrected Written Opinion mailed May 8, 2013", 4 pgs.
"International Application Serial No. PCT/US2012/066077, International Preliminary Report on Patentability mailed Jun. 4, 2015", 6 pgs.
"International Application Serial No. PCT/US2012/066094, Response filed Jul. 16, 2014 to Written Opinion mailed May 9, 2013", 3 pgs.
"International Application Serial No. PCT/US2012/066077, International Search Report mailed May 8, 2013", 4 pgs.
"International Application Serial No. PCT/US2012/066077, Written Opinion mailed May 8, 2013", 4 pgs.
"International Application Serial No. PCT/US2012/066094, International Search Report mailed May 9, 2013".
"International Application Serial No. PCT/US2012/066094, Written Opinion mailed May 9, 2013".
Finger, J. T, et al., "Development plan for an advanced drilling system with real-time diagnostics (Diagnostics-While-Drilling)", Sandia Report, SAND2000-0239, (Feb. 2000), 65 pgs.
Meehan, R. J, et al., "Drill Bit Seismic: A Drilling Optimization Tool", IADC/SPE Drilling Conference, Mar. 3-6, 1998, Dallas, Texas, IADC/SPE 39312, (1998), 177-190.
Soufi, Naser, "Shale Pressure Measurements Methods", NTNU, Det skapende universitet, http://www.ipt.ntnu.no/~norne/wiki/data/media/english/thesis/naser-soufi.pdf, (2009), 148 pgs.
"Canadian Application Serial No. 2,891,162, Office Action mailed Aug. 3, 2015", 3 pgs.
"Russian Application Serial No. 2015117956, Office Action mailed Mar. 21, 2016", W/ English Translation, 10 pgs.

* cited by examiner

ACOUSTIC SIGNAL ENHANCEMENT APPARATUS, SYSTEMS, AND METHODS

PRIORITY APPLICATIONS

This application is a U.S. National Stage Filing under 35 U.S.C. 371 from International Application No. PCT/US2012/066077, filed on 20 Nov. 2012, and published as WO 2014/081416 on 30 May 2014, which application and publication are incorporated herein by reference in their entirety.

BACKGROUND

In down hole acoustic telemetry systems, signals carrying information are transmitted via compressional waves from the bottom hole assembly (BHA) along a drill string to the Earth's surface. These signals are received by a sensor at the surface, such as an accelerometer. When the drill pipe contacts the borehole wall over more than a nominal area, signal power is lost due to absorption by the surrounding formation. The loss can be especially significant when horizontal wells are drilled, as the contact area can be relatively large.

DETAILED DESCRIPTION

A device known as an agitator (e.g., a mud motor) is sometimes used in extended reach horizontal wells to enhance drilling operation efficiency by breaking the friction force between the formation and the drill string. However, the vibration that results from agitation often interferes with mud pulse telemetry communications, such as the communication of data used during measurement while drilling (MWD), logging while drilling (LWD), or formation evaluation while drilling (FEWD) operations. Thus, another device, known as a shock sub, is frequently used in the drill string to reduce the harmonics of the hammer frequency (vibration) set up by the agitator. That is, the shock sub is used to absorb and dissipate shock loading in the string, to provide a more stable platform for the acquisition of data. Examples include the down hole shock subs available from the Stabil Drill company of Lafayette, La.; and the impact and shock reduction subs available from Schlumberger Oilfield Services in Houston, Tex.

To address some of these challenges, among others, the inventors have discovered a mechanism that can be used to reduce static friction by changing some of the static friction between the drill string and the borehole wall to dynamic friction during drilling operations. This mechanism, which comprises an unconventional combination of a fluid pulse source and a shock sub, will be designated as a telemetry enhancement device (TED) herein.

One component of the TED is a fluid pulse source (FPS), such as a Moineau motor, or some other type of positive displacement pump, such as a progressive cavity pump, which is controlled or inherently designed to set up vibrations along an attached drill string at a relatively low frequency, such as less than 100 cycles/second in some embodiments. While conventional Moineau motors, including mud motors, are used to power the bit in a drill string, the FPS in various embodiments of the TED converts rotary motion into pressure pulses by passing the fluid within the motor through a fluid exit orifice. As the flow of fluid (e.g., drilling fluid or "mud") moves past the shaft of the rotor, the rotor moves back and forth as it rotates. When the shaft is directly in line with the orifice, the fluid flow is dramatically reduced. When the shaft moves to the side, the fluid may flow more freely, since there is little resistance to the flow.

Figure 1:
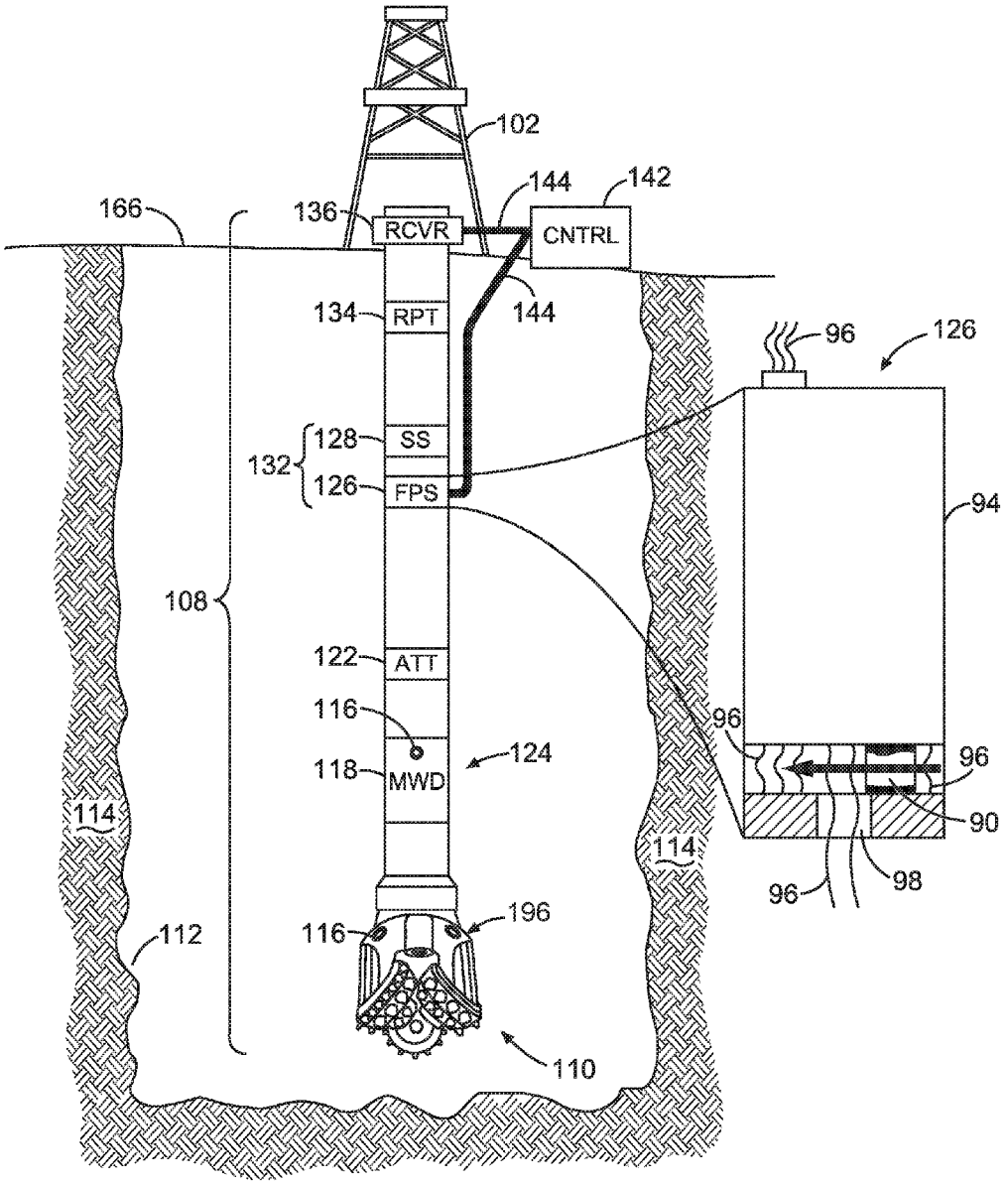
FIG. 1 is a block diagram of an apparatus, according to various embodiments of the invention.

This activity can be viewed in the breakout section of FIG. 1, detailing the movement of the motor shaft 90 in the Moineau motor 94, operating as an FPS. Here it can be seen that as the fluid 96 flows through the motor 94, and the rotating shaft 90 oscillates back and forth, moving in the figure from right to left (indicated by the large, dark arrow), an orifice 98 installed at the end of the motor 94 will be at least partially blocked, and then opened.

The resulting pressure pulses are converted into axial motion of the drill string by an unconventional use of a shock sub, which is also installed in the drill string as part of the TED. In various embodiments, the shock sub is excited by the pressure pulses from the FPS at a fundamental frequency that serves to increase the amplitude of axial vibrations in the drill string, instead of reducing them. To enhance operation, the fundamental frequency may be selected to excite one or more resonant modes within the shock sub, to induce even larger vibrations in the drill string.

The net effect of this unconventional combination of an FPS and a shock sub, operating as a TED, is to decouple the drill string from the borehole wall, with the fundamental frequency of TED operation selected to be outside of the operational communications frequency range of an associated acoustic telemetry communications system. Since the TED's frequency of operation can be selected to be well below the frequencies used in acoustic telemetry communications, the vibrations induced in the drill string should not interfere with acoustic telemetry system operations.

The mechanism disclosed herein can be quite useful in many drilling operations, including sliding and horizontal drilling operations. Several possible drill string configurations that can be used as a part of such operations, each of which includes one or more TEDs, will now be described.

FIG. 1 is a block diagram of an apparatus 100, according to various embodiments of the invention. Here a drilling rig 102 can be seen disposed above a drill string 108 with a bit 196 that is used to drill into a formation 114 to make a borehole 112.

In this configuration 110 of the drill string 108, the FPS 126 and the shock sub 128 combine to form a TED 132. An associated telemetry communications system comprises an acoustic telemetry transmitter 122 and an acoustic telemetry receiver 136. One or more acoustic telemetry repeaters 134 may form part of the acoustic telemetry system as well.

In some embodiments, telemetry system communications may best be enhanced by locating the TED 132 as close to the acoustic telemetry transmitter 122 as possible. Thus, in some embodiments, it may be useful to assemble the drill string 108 so that the acoustic telemetry transmitter 122 that is closest to the bit 196 is located just below the TED 132 when the string 108 is disposed vertically in the borehole 112. In other arrangements, such as when a TED 132 is installed between the transmitter 122 and an MWD/LWD-FEWD sub 118 (see e.g., configuration 220 in FIG. 2), communication of data and commands to/from the MWD/LWD/FEWD sub 118 may be accomplished using short hop electromagnetic telemetry, short hop acoustic telemetry, or wired communication between the transmitter 122 and the MWD/LWD/FEWD sub 118.

A controller 142 and sensors 116 may comprise a part of the apparatus 100. Thus, in some embodiments, the operation of the TED 132 is controlled by a controller 142, perhaps coupled directly to the TED 132 via communication lines 144, or indirectly, via an acoustic telemetry system, comprising a transmitter 122 and a receiver 136. The controller 142 may be internal to the TED 132, or it may be housed by the MWD/LWD/FEWD sub 118, to communicate with the TED 132 via short hop telemetry.

One or more sensors 116, such as rotation, acceleration, orientation, stress/strain, gyroscopic, weight on bit, bit angle, torque, and others may be used to indicate to the controller 142 that sticking of the drill string 108 is present. When such indications are presented to the controller 142, signals may be sent to the FPS 126 by the controller 142, causing the FPS 126 to operate so as to increase the vibrations of the drill string 108. Similarly, when indications of sticking are not present, the controller 142 can issue commands to the FPS 126 to decrease the vibrations of the drill string 108.

Figure 2:
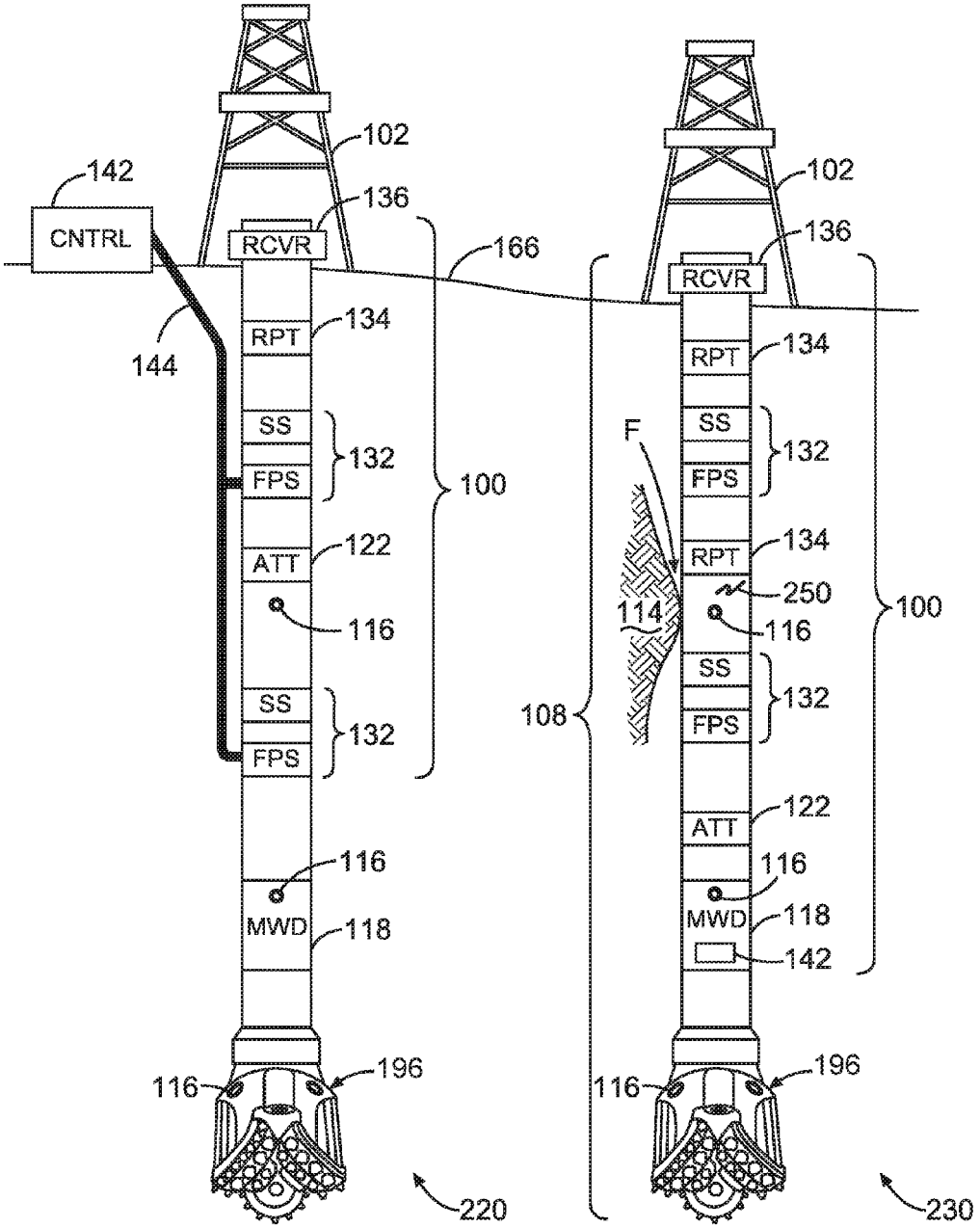
FIG. 2 illustrates two different configurations of the apparatus shown in FIG. 1, according to various embodiments of the invention.

FIG. 2 illustrates two additional configurations 220, 230 of the apparatus 100 shown in FIG. 1, according to various embodiments of the invention. In the first configuration 220, multiple TEDs 132 are attached to and form part of the drill string 108. Here a controller 142 is located at the surface 166, with TEDs 132 being deployed above and below the acoustic telemetry transmitter 122.

In the second configuration 230, multiple TEDs 132 are again in use. However, in this case, the TEDs 132 are deployed above and below at least one repeater 134.

In addition, the controller 142 in configuration 230 is attached to the string 108, forming part of the MWD/LWD/FWED sub 118 in this case. Thus, the configuration 230 is an example of an autonomous one—indications 250 of sticking friction F between the string 108 and the formation 114, perhaps provided directly by the sensors 116, are communicated to the controller 142 forming part of the string 108, and one or more of the TEDs 132 can be used selectively to relieve the condition by increasing the vibration in the string 108 at particular locations. Indications 250 of sticking may also be derived by the controller 142 from signals provided by the sensors 116, as is well known to those of ordinary skill in the art.

The sensor 116 attached to the MWD/LWD/FWED sub 118 in configuration 220 may comprise an acoustic sensor. This sensor can be mounted in the location shown, or at any location between the MWD/LWD/FWED sub 118 and the lower TED 132 (i.e., the TED 132 that is closest to the MWD/LWD/FWED sub 118), and used to monitor signal path transmissibility. The transmissibility characteristics of the signal path between the lower TED 132 and the sensor 116 is not particularly important in and of itself, but may be used as an indication of the transmissibility in the neighborhood of the lower TED 132, including the area above the lower TED 132.

Many other configurations, including combinations of the configurations 220, 230 are possible. A configuration that might be used in both vertical and horizontal drilling operations will now be described.

Figure 3:
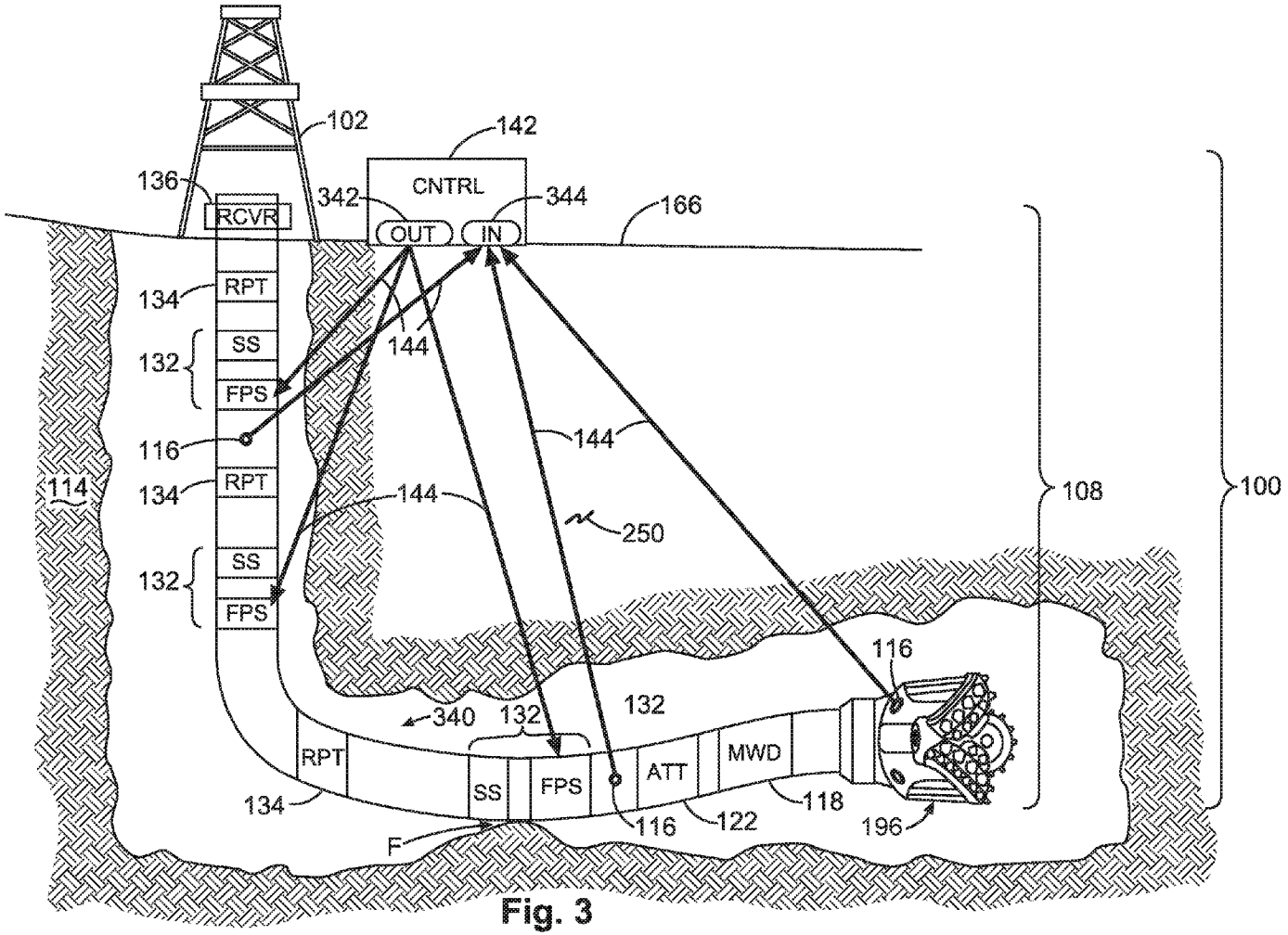
FIG. 3 illustrates another configuration of the apparatus shown in FIG. 1, as might be used during horizontal drilling operations, according to various embodiments of the invention.

Thus, FIG. 3 illustrates another configuration 340 of the apparatus 100 shown in FIG. 1, as might be used during horizontal drilling operations, according to various embodiments of the invention. In this case, multiple TEDs 132 are deployed in pairs, to surround multiple repeaters 134. At least one of the TEDs 132 has been attached to the drill string 108 so that it is located at a point where sticking against the formation 114 is expected to occur. In this way, when indications 250 of sticking are presented to the input connections 344 of the controller 142 by the sensors 116, the controller 142 can apply signals to its output connections 342, by way of the communication lines 144, to increase the vibrations caused by one or more of the TEDs 132. Signaling via the communication lines 144, both to and from the controller 142, may occur directly or indirectly, as explained previously. Thus many embodiments may be realized.

Figure 4:
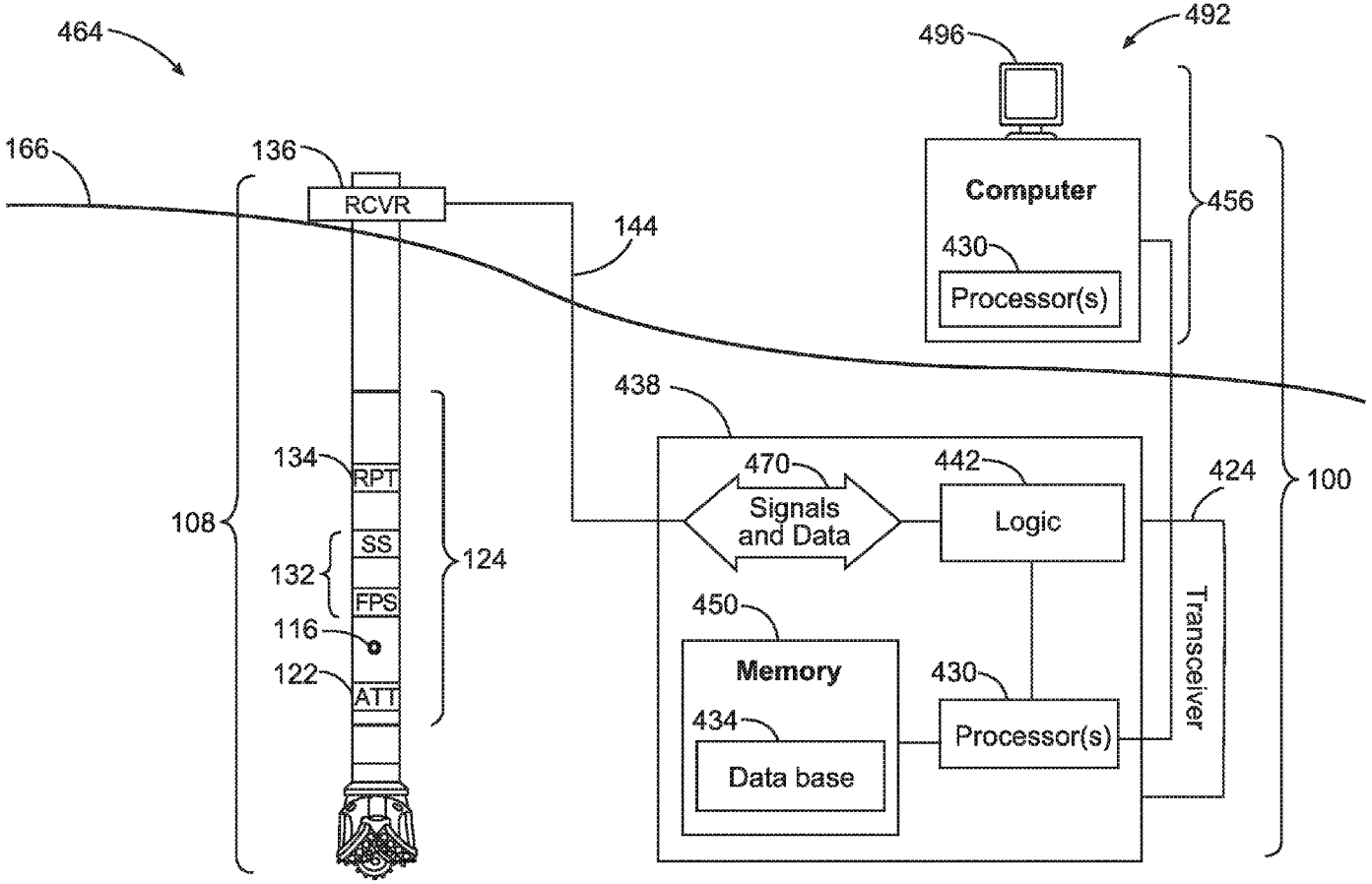
FIG. 4 illustrates apparatus and systems according to various embodiments of the invention.

For example, FIG. 4 illustrates apparatus 100 and systems 464 according to various embodiments of the invention. Here, a system 464 may comprise one or more apparatus 100, used in one or more configurations, or in one or more combinations of configurations, as described previously. In various embodiments, different parts of the apparatus 100 may be distributed to different locations within the system 464.

For example, an apparatus 100 that operates in conjunction with the system 464 may comprise portions of a down hole tool 124 (e.g., an MWD, LWD, or FWED tool) that includes one or more TEDs 132 and acoustic telemetry transmitters 122 and/or repeaters 134.

The system 464 may include logic 442, perhaps comprising a TED control system. The logic 442 can be used to acquire sensor signals and other data 470, and to communicate data/commands to the TEDs 132. The logic 442, as part of a data acquisition and control system 438, may also serve to acquire formation property information.

The data acquisition and control system 438 may be coupled to the tool 124, to receive signals and data 470 generated by sensors 116. The data acquisition and control system 438, and/or any of its components, may be located down hole, perhaps in a tool housing or tool body, or at the surface 166, perhaps as part of a computer workstation 456 in a surface logging facility 492.

In some embodiments of the invention, the apparatus 100 can operate to perform the functions of the workstation 456, and these results can be transmitted to the surface 166 and/or used to directly control the TEDs 132 within the apparatus 100, perhaps using direct wiring, and/or a telemetry transceiver (transmitter-receiver) 424. Processors 430 may operate on signals and data 470 acquired from down hole sensors 116 and stored in the memory 450, perhaps in the form of a database 434. The operation of the processors 430 may include controlling the functions of the TEDs 132, as well as determining various properties of the formation surrounding the string 108. Thus, referring now to FIGS. 1-4, it can be seen that many embodiments may be realized.

For example, in its most basic form, an apparatus 100 may comprise an FPS 126 and a shock sub 128 that can operate as a TED 132. In some embodiments, the apparatus 100 comprises an acoustic telemetry transmitter 122, an FPS 126 having a fundamental frequency of pulsation (which may be selectable in some embodiments), and a shock sub 128.

The FPS 126 can be operable to excite vibrations in the shock sub 128 so as to increase axial vibration in a drill string 108 mechanically coupled to the FPS 126 and the shock sub 128. The excitation of vibrations in the shock sub 128 serve to reduce static friction F between the drill string 108 and a formation 114 surrounding the drill string 108. In most embodiments, the vibrations are excited at a fundamental frequency that is outside of the operational acoustic communications frequency range of the telemetry transmitter 122.

In some embodiments, the fundamental frequency of TED 132 operation is fixed. In some embodiments, the apparatus 100 includes a controller 142 to adjust the fundamental frequency of TED 132 operation. Indications of sticking, presented to the controller 142, can be used to increase or decrease the vibrations provided by the TED 132. These indications can be based on a number of measured physical phenomena associated with drilling operations, such as an increased amount of torque over time, or the number of occurrences of increased torque, over time, among others. Thus, the controller 142 may be operable to adjust the fundamental frequency of TED 132 operation responsive to indications of sticking in the drill string 108.

The controller 142 may also be operable to moderate operation of the FPS 126 and the acoustic telemetry transmitter 122 with respect to on-off operation and/or frequency of operation. For example, in some embodiments, the controller 142 may be operable to turn off and turn on one or more TEDs 132. The controller 142 may also be operable to independently turn off or turn on the telemetry transmitter 122 and/or one or more repeaters 124 or telemetry receivers 136. In some embodiments, the controller 142 may be operable to adjust the fundamental frequency of operation for the FPS 126, perhaps by commanding valves internal or external to the FPS 126 to move, adjusting the volume or rate of fluid flowing through the FPS 126.

In some embodiments, the FPS 126 may comprise a mud motor, such as a Moineau motor or a turbine. In some embodiments, the FPS 126 may comprise a siren.

In some embodiments, one or more acoustic telemetry transmitters 122 may be located between a pair of TEDs 132. Similarly, one or more acoustic telemetry repeaters 134 may be located between a pair of TEDs 132, or between an acoustic telemetry receiver 136 and a TED 132. Many other configurations are possible.

In many embodiments, the array of possible configurations should make it possible to increase the reliability (or maintain reliability with an increased data rate) of down hole acoustic communications. This benefit, in turn, may reduce drilling expenses, since the spacing between acoustic telemetry transmitters, and repeaters may be increased. The spacing between repeaters themselves may also be increased. Still further embodiments and advantages may be realized.

Figure 5:
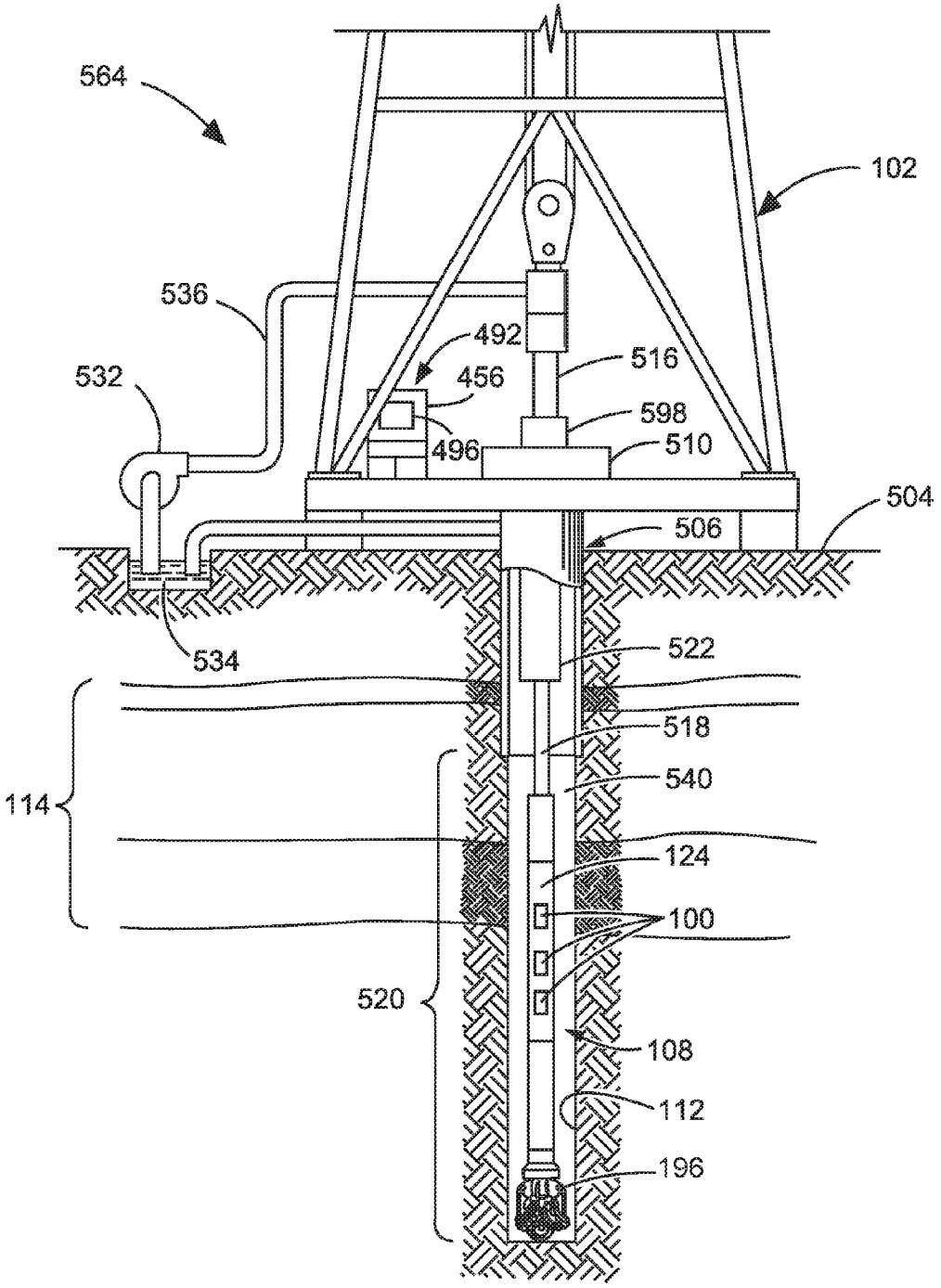
FIG. 5 illustrates a while-drilling system embodiment of the invention.

For example, FIG. 5 illustrates a while-drilling system 564 embodiment of the invention. The system 564 may comprise portions of a down hole tool 124 as part of a down hole drilling operation.

Here it can be seen how a system 564 may form a portion of a drilling rig 102 located at the surface 504 of a well 506. The drilling rig 102 may provide support for a drill string 108. The drill string 108 may operate to penetrate a rotary table 510 for drilling a borehole 112 through subsurface formations 114. The drill string 108 may include a kelly 516, drill pipe 518, and a bottom hole assembly 520, perhaps located at the lower portion of the drill pipe 518.

The bottom hole assembly 520 may include drill collars 522, a down hole tool 124, and a drill bit 196. The drill bit 196 may operate to create a borehole 112 by penetrating the surface 504 and subsurface formations 114. The down hole tool 124 may comprise any of a number of different types of tools including MWD tools, LWD tools, FEWD tools, and others.

During drilling operations, the drill string 108 (perhaps including the kelly 516, the drill pipe 518, and the bottom hole assembly 520) may be rotated by the rotary table 510. In addition to, or alternatively, the bottom hole assembly 520 may also be rotated by a motor (e.g., a mud motor) that is located down hole. The drill collars 522 may be used to add weight to the drill bit 196. The drill collars 522 may also operate to stiffen the bottom hole assembly 520, allowing the bottom hole assembly 520 to transfer the added weight to the drill bit 196, and in turn, to assist the drill bit 196 in penetrating the surface 504 and subsurface formations 114.

During drilling operations, a mud pump 532 may pump drilling fluid (sometimes known by those of skill in the art as "drilling mud") from a mud pit 534 through a hose 536 into the drill pipe 518 and down to the drill bit 196. The drilling fluid can flow out from the drill bit 196 and be returned to the surface 504 through an annular area 540 between the drill pipe 518 and the sides of the borehole 112. The drilling fluid may then be returned to the mud pit 534, where such fluid is filtered. In some embodiments, the drilling fluid can be used to cool the drill bit 196, as well as to provide lubrication for the drill bit 196 during drilling operations. Additionally, the drilling fluid may be used to remove subsurface formation cuttings created by operating the drill bit 196, as well as to operate one or more TEDs forming part of the apparatus 100.

Thus, referring now to FIGS. 1-5, it may be seen that in some embodiments, a system 564 may include a down hole tool 124 to house one or more apparatus 100 and/or systems 464, similar to or identical to the apparatus 100 and systems 464 described above and illustrated in FIGS. 1-4. Thus, for the purposes of this document, the term "housing" may include any type of down hole tool 124 (having an outer wall that can be used to enclose or attach to instrumentation, sensors, fluid sampling devices, pressure measurement devices, processors, TEDs, and data acquisition systems). Many embodiments may thus be realized.

For example, in some embodiments a system 464, 564 may comprise an acoustic telemetry transmitter 122 coupled to a drill string 108, the acoustic telemetry transmitter 122 having an operational acoustic communications frequency range. The system 464, 564 may further comprise an acoustic telemetry receiver 136 coupled to the drill string 108 to receive acoustic telemetry information transmitted by the acoustic telemetry transmitter 122.

The system 464, 564 may further include an FPS 126 having a selectable fundamental frequency of pulsation, and a shock sub 128, wherein the FPS is operable to excite vibrations in the shock sub 128 so as to increase axial vibration in the drill string 108 (mechanically coupled to the FPS 126 and the shock sub 128), to reduce static friction F between the drill string 108 and the surrounding formation 114. As before the vibrations excited by the FPS 126 should be at a fundamental frequency selected to be outside of the operational acoustic communications frequency range used by the acoustic telemetry transmitter 122 and the acoustic telemetry receiver 136.

Many configurations are possible. For example, in some embodiments, the acoustic telemetry transmitter 122 is located closer to the bit 196 (attached to the drill string 108) than the fluid pulse source 126 and the shock sub 128. In some embodiments, an acoustic telemetry repeater 134 is located between the acoustic telemetry receiver 136 and a combination of the FPS 126 and the shock sub 128 that is configured to operate as a TED 132.

In other examples, multiple instances of the FPS 126 and shock sub 128 are configured to operate as individual, selectably operable, TEDs 132. In some embodiments, multiple acoustic telemetry repeaters 134 are disposed between individual ones of the selectably operable TEDs 132. In some embodiments, an acoustic telemetry transmitter 122 is disposed between an FPS 126 and shock sub 128 configured to operate as a first TED 132, and a second TED 132 comprising another FPS 126 and shock sub 128.

A controller 142 may form part of the system 464, 564 in some embodiments. The controller 142 may be operable to moderate operation of the fluid pulse source and the acoustic telemetry transmitter with respect to on-off operation and/or frequency of operation.

The apparatus 100; drilling rig 102; drill string 108; configurations 110, 220, 230, 340; borehole 112; formations 114; sensors 116; FPS 126; shock sub 128; TEDs 132; transmitter 122; receiver 136; controller 142; communication lines 144; surface 166; indications 250; output connections 342; input connections 344; processors 430; database 434; data acquisition and control system 438; logic 442; memory 450; workstation 456; logging facility 492; display 496; surface 504; well 506; rotary table 510; kelly 516; drill pipe 518; bottom hole assembly 520; drill collars 522; mud pump 532; mud pit 534; hose 536; and friction F may all be characterized as "modules" herein.

Such modules may include hardware circuitry, a processor, memory circuits, software program modules and objects, firmware, and/or combinations thereof, as desired by the architect of the apparatus 100 and systems 464, 564, and as appropriate for particular implementations of various embodiments. For example, in some embodiments, such modules may be included in an apparatus and/or system operation simulation package, such as a software electrical signal simulation package, a power usage and distribution simulation package, a power/heat dissipation simulation package, and/or a combination of software and hardware used to simulate the operation of various potential embodiments.

It should also be understood that the apparatus and systems of various embodiments can be used in applications other than for logging operations, and thus, various embodiments are not to be so limited. The illustrations of apparatus 100 and systems 464, 564 are intended to provide a general understanding of the structure of various embodiments, and they are not intended to serve as a complete description of all the elements and features of apparatus and systems that might make use of the structures described herein.

Applications that may include the novel apparatus and systems of various embodiments may include electronic circuitry used in high-speed computers, communication and signal processing circuitry, modems, processor modules, embedded processors, data switches, application-specific modules, or combinations thereof. Such apparatus and systems may further be included as sub-components within a variety of electronic systems, such as televisions, cellular telephones, personal computers, workstations, radios, video players, vehicles, signal processing for geothermal tools and smart transducer interface node telemetry systems, among others. Some embodiments include a number of methods.

Figure 6:
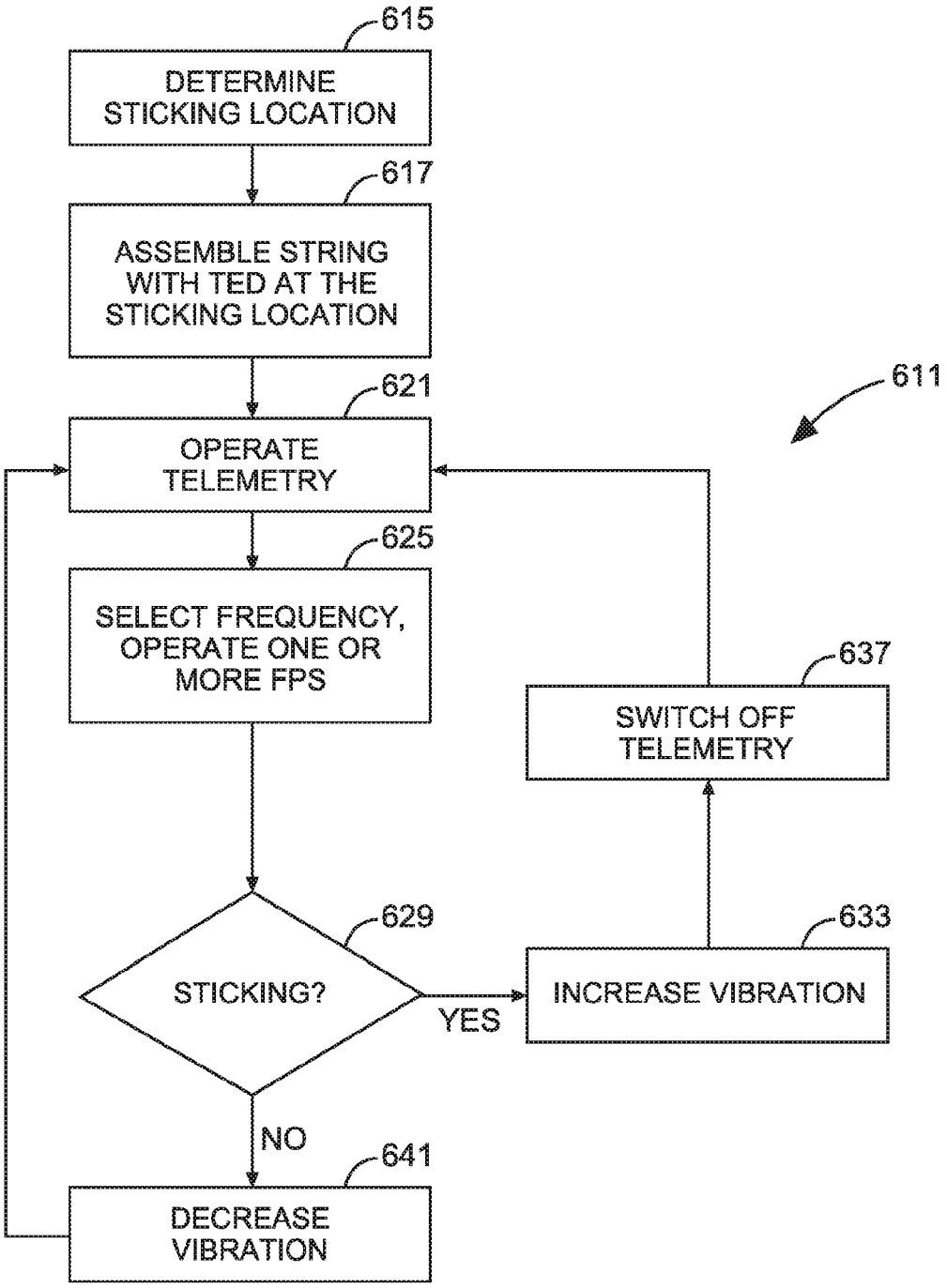
FIG. 6 is a flow chart illustrating several methods according to various embodiments of the invention.

For example, FIG. 6 is a flow chart illustrating several methods 611 of operating TEDs using a selectable fundamental vibration frequency. For example, a method 611 may comprise operating an FPS (such as a siren, a mud pulser, or a drilling fluid motor, including a Moineau motor or turbine, or any other device that produces fluid pressure pulses at a selected frequency responsive to fluid flowing into or through the device) to induce vibrations in a shock sub so as to increase axial drill string vibration, enhancing acoustic telemetry communications via the reduction of incidents of drill string sticking. In most embodiments, the FPS and the shock sub can be configured to co-operate as a TED, with a configured location on a drill string where sticking is expected to occur, due to sag in the drill pipe.

Those of ordinary skill in the art, after reading this document and the included figures, will note that components forming a drill string normally occupy a fixed position along the string once they are lowered down hole. Thus, the drill string configuration for various embodiments is normally selected prior to insertion down hole, such that portions of the drill string that are most subject to sticking will have TEDs suitably placed. In some cases, when a first section of a drill string is more likely to stick to the formation than a second section of drill string as they move along the borehole, the two sections maintain this propensity throughout the borehole.

For example, consider the existence of two intervals on a single drill string: a first interval AB and a second interval CD. As the intervals AB and CD move along the borehole in the same topological relation to each other, they will pass different parts of the formation. Thus, if interval AB is lower on the drill string (e.g., closer to the bit) than interval CD, then AB will pass through a given region of the formation before interval CD does. It turns out that if interval AB is more likely than interval CD to stick in one region, as the two intervals pass through the region (even though each interval arrives at the sticking region at different times), then interval AB is often more likely than interval CD to exhibit sticking in another region of the formation, as well. This is because a difference in sticking behavior is often caused by a difference in the placement of various drill sting elements, such as stabilizers, heavy weight drill pipe, drill collars, bent subs, etc.—the placement of these elements usually does not vary once the drill string has been lowered down hole.

Thus, a processor-implemented method 611 to execute on one or more processors that perform the method may begin at block 615 with determining an approximate location of sticking for a drill string, such as a location on a horizontal section of the drill string. A "horizontal section" of a drill string means a portion of the drill string that, when used for drilling operations, is expected to travel in a direction that is closer to being parallel to the Earth's surface, rather than perpendicular to it.

The determination of one or more potential sticking locations can be made in an automated fashion, using a computer-aided design program, or a simulation program, for example. Once the determination is made, the method 611 may continue on to block 617 to include assembling an FPS and a shock sub to operate as a TED positioned at the approximate location(s) along the drill string where sticking is expected.

The method 611 may continue on to block 621 to include operating an acoustic telemetry communications system. This activity may include turning on one or more parts of the system, such as transmitters, receivers, and/or repeaters.

In most embodiments, the method 611 continues on to block 625 to include operating an FPS using drilling fluid to excite vibrations in the shock sub so as to increase axial vibration in a drill string, and to reduce static friction between the drill string and the formation surrounding the drill string. Operation of the FPS includes turning the FPS on, to provide fluid pulses, and turning the FPS off, so that the FPS ceases to provide fluid pulses.

In some embodiments, the FPS is manufactured to provide a fixed fundamental frequency of operation. In some embodiments, the fundamental frequency of the FPS may be selected prior to placement down hole, or selected during use, perhaps by activating valves and/or pumps to control the quantity or rate of fluid flow, and/or using solenoids or other devices to mechanically adjust the amount of open area of the FPS exit orifice.

Vibrations in the drill string may be excited at this fundamental frequency, which may be selected to be outside of the operational communications frequency range of an associated acoustic telemetry communications system. Thus, the method 611 may further include, at block 625, selecting the fundamental frequency of operation for the FPS. For example, the fundamental frequency of operation might be selected to approximate a resonant frequency of the shock sub. The fundamental frequency of operation might be selected to fall outside of the operational range for an acoustic telemetry communications system, such as outside of a frequency range of about 400 cycles/second to about 5000 cycles/second.

Selected sequencing of multiple TED units, such as sequential operation of the TEDs along a drill string, may be useful in reducing sticking at multiple locations. The vibration of paired TEDs may be sequenced, or combined, to reduce the sticking at a single location—between the TEDs. Thus, the activity at block 625 may also include operating multiple instances of the FPS and the shock sub in combination, as multiple TEDs, in a preselected sequence.

The method 611 may go on to block 629 to make a determination as to whether sticking has occurred, perhaps by directly receiving an indication of sticking associated with the drill string (e.g., an indication that rotation has ceased, even with the application of power to the string), or indirectly receiving the indication via a sensor signal that exceeds a selected threshold, above which sticking is indicated (e.g., the torque in the string is more than twice the normal/expected levels for drilling in the type of formation currently surrounding the drill bit). In this case, the method 611 may continue on to block 633 to include operating the FPS using the drilling fluid to excite vibrations in the shock sub, responsive to receiving the indication of sticking. The level of axial vibrations induced in the string may thus be increased at block 633.

As the level of axial vibration increases, it may be useful or desirable to turn off the telemetry transmitter and/or receiver. Such operation can save power down hole, for example. Thus, the method 611 may continue on to block 637, with switching off one or more portions of the telemetry communications system (e.g., a transmitter, a receiver, one or more repeaters, etc.).

If no sticking is encountered, or if sticking is no longer indicated, as determined at block 629, the method 611 may continue on to block 641. The activity at block 641 may include decreasing the level of axial vibrations induced in the string, perhaps by reducing or shutting off the flow of drilling fluid into the FPS forming part of one or more TEDs.

It should be noted that the methods described herein do not have to be executed in the order described, or in any particular order. Moreover, various activities described with respect to the methods identified herein can be executed in iterative, serial, or parallel fashion. Information, including parameters, commands, operands, and other data, can be sent and received in the form of one or more carrier waves.

The apparatus 100 and systems 464, 564 may be implemented in a machine-accessible and readable medium that is operational over one or more networks. The networks may be wired, wireless, or a combination of wired and wireless. The apparatus 100 and systems 464, 564 can be used to implement, among other things, the processing associated with the methods 611 of FIG. 6. Modules may comprise hardware, software, and firmware, or any combination of these. Thus, additional embodiments may be realized.

Figure 7:
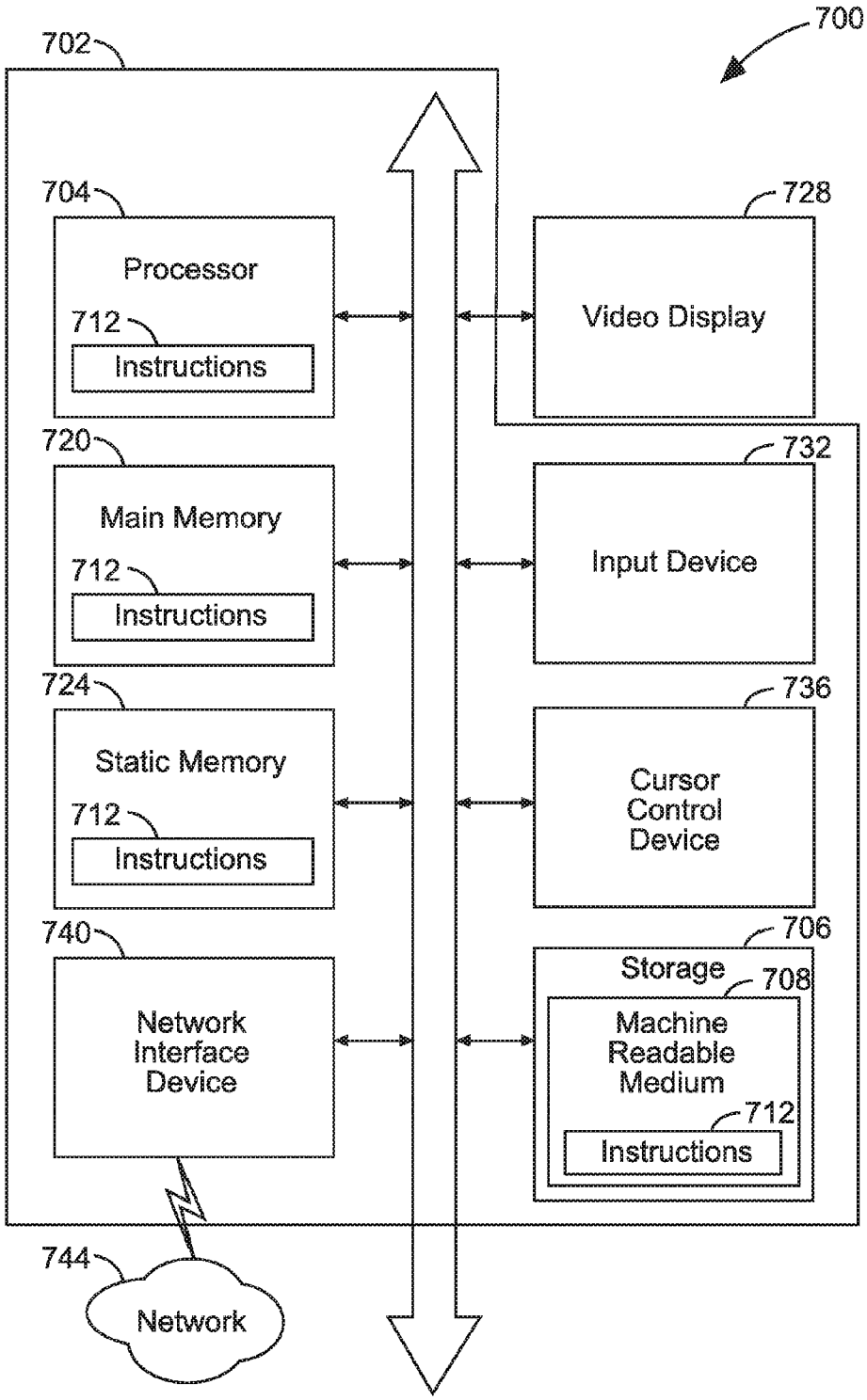
FIG. 7 is a block diagram of an article of manufacture, including a specific machine, according to various embodiments of the invention.

For example, FIG. 7 is a block diagram of an article 700 of manufacture, including a specific machine 702, according to various embodiments of the invention. Upon reading and comprehending the content of this disclosure, one of ordinary skill in the art will understand the manner in which a software program can be launched from a computer-readable medium in a computer-based system to execute the functions defined in the software program.

One of ordinary skill in the art will further understand the various programming languages that may be employed to create one or more software programs designed to implement and perform the methods disclosed herein. For example, the programs may be structured in an object-orientated format using an object-oriented language such as Java or C++. In another example, the programs can be structured in a procedure-oriented format using a procedural language, such as assembly or C. The software components may communicate using any of a number of mechanisms well known to those of ordinary skill in the art, such as application program interfaces or interprocess communication techniques, including remote procedure calls. The teachings of various embodiments are not limited to any particular programming language or environment. Thus, other embodiments may be realized.

For example, an article 700 of manufacture, such as a computer, a memory system, a magnetic or optical disk, some other storage device, and/or any type of electronic device or system may include one or more processors 704 coupled to a machine-readable medium 708 such as memory (e.g., removable storage media, as well as any memory including an electrical, optical, or electromagnetic conductor) having instructions 712 stored thereon (e.g., computer program instructions), which when executed by the one or more processors 704 result in the machine 702 performing any of the actions described with respect to the methods above.

The machine 702 may take the form of a specific computer system having a processor 704 coupled to a number of components directly, and/or using a bus 716. Thus, the machine 702 may be incorporated into the apparatus 100 or systems 464, 564 shown in FIGS. 1-5, perhaps as part of the processors 430, logic 442, or workstation 456.

Turning now to FIG. 7, it can be seen that the components of the machine 702 may include main memory 720, static or non-volatile memory 724, and mass storage 706. Other components coupled to the processor 704 may include an input device 732, such as a keyboard, or a cursor control device 736, such as a mouse. An output device 728, such as a video display, may be located apart from the machine 702 (as shown), or made as an integral part of the machine 702.

A network interface device 740 to couple the processor 704 and other components to a network 744 may also be coupled to the bus 716. The instructions 712 may be transmitted or received over the network 744 via the network interface device 740 utilizing any one of a number of well-known transfer protocols (e.g., HyperText Transfer Protocol). Any of these elements coupled to the bus 716 may be absent, present singly, or present in plural numbers, depending on the specific embodiment to be realized.

The processor 704, the memories 720, 724, and the storage device 706 may each include instructions 712 which, when executed, cause the machine 702 to perform any one or more of the methods described herein. In some embodiments, the machine 702 operates as a standalone device or may be connected (e.g., networked) to other machines. In a networked environment, the machine 702 may operate in the capacity of a server or a client machine in server-client network environment, or as a peer machine in a peer-to-peer (or distributed) network environment.

The machine 702 may comprise a personal computer (PC), a tablet PC, a set-top box (STB), a PDA, a cellular telephone, a web appliance, a network router, switch or bridge, server, client, or any specific machine capable of executing a set of instructions (sequential or otherwise) that direct actions to be taken by that machine to implement the methods and functions described herein. Further, while only a single machine 702 is illustrated, the term "machine" shall also be taken to include any collection of machines that individually or jointly execute a set (or multiple sets) of instructions to perform any one or more of the methodologies discussed herein.

While the machine-readable medium 708 is shown as a single medium, the term "machine-readable medium" should be taken to include a single medium or multiple media (e.g., a centralized or distributed database, and/or associated caches and servers, and or a variety of storage media, such as the registers of the processor 704, memories 720, 724, and the storage device 706 that store the one or more sets of instructions 712. The term "machine-readable medium" shall also be taken to include any medium that is capable of storing, encoding or carrying a set of instructions for execution by the machine and that cause the machine 702 to perform any one or more of the methodologies of the present invention, or that is capable of storing, encoding or carrying data structures utilized by or associated with such a set of instructions. The terms "machine-readable medium" or "computer-readable medium" shall accordingly be taken to include non-transitory, tangible media, such as solid-state memories and optical and magnetic media.

Various embodiments may be implemented as a standalone application (e.g., without any network capabilities), a client-server application or a peer-to-peer (or distributed) application. Embodiments may also, for example, be deployed by Software-as-a-Service (SaaS), an Application Service Provider (ASP), or utility computing providers, in addition to being sold or licensed via traditional channels.

Using the apparatus, systems, and methods disclosed herein may provide the advantages of reducing the number of relatively expensive acoustic repeaters that are used to form part of a drill string. The reduced complexity of such a telemetry system should serve to reduce overall equipment failure rates. Increased data rates may be realized, directly, via higher rates due to less acoustic noise between nodes, and/or indirectly, since a reduced number of nodes provide reduced latency in the communications bit sequence. Increased client satisfaction may result.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus, comprising:

an acoustic telemetry transmitter having an operational acoustic communications frequency range;

a fluid pulse source having a fundamental frequency of pulsation;

a shock sub, wherein the fluid pulse source is operable to excite vibrations in the shock sub so as to increase axial vibration in a drill string mechanically coupled to the fluid pulse source and the shock sub, to reduce static friction between the drill string and a formation surrounding the drill string, wherein the vibrations are excited at the fundamental frequency that is selected to be outside of the operational acoustic communications frequency range;

a controller operable to control the acoustic telemetry transmitter and the fluid pulse source, individually and in combination, including control of adjustment of the fundamental frequency of the fluid pulse source and frequency of the acoustic telemetry transmitter, wherein the fluid pulse source and the shock sub are configured to operate as a first telemetry enhancement device, and wherein the acoustic telemetry transmitter is disposed between the first telemetry enhancement device and a second telemetry enhancement device comprising a second fluid pulse source and a second shock sub.

2. The apparatus of claim 1, wherein the controller is attached to the drill string at a position downhole in a borehole of the formation.

3. The apparatus of claim 2, wherein the controller is operable to adjust the fundamental frequency responsive to indications of sticking in the drill string.

4. The apparatus of claim 1, wherein the fluid pulse source comprises a mud motor.

5. The apparatus of claim 4, wherein the mud motor comprises one of a Moineau motor or a turbine.

6. The apparatus of claim 1, wherein the fluid pulse source comprises a siren.

7. A system, comprising:

an acoustic telemetry transmitter coupled to a drill string, the acoustic telemetry transmitter having an operational acoustic communications frequency range;

an acoustic telemetry receiver coupled to the drill string to receive acoustic telemetry information transmitted by the acoustic telemetry transmitter;

a fluid pulse source having a fundamental frequency of pulsation;

a shock sub, wherein the fluid pulse source is operable to excite vibrations in the shock sub so as to increase axial vibration in the drill string mechanically coupled to the fluid pulse source and the shock sub, to reduce static friction between the drill string and a formation surrounding the drill string, wherein the vibrations are excited at the fundamental frequency that is selected to be outside of the operational acoustic communications frequency range used by the acoustic telemetry transmitter and the acoustic telemetry receiver; and a controller operable to control the acoustic telemetry transmitter, the acoustic telemetry receiver and the fluid pulse source, individually and in combination, including control of adjustment of the fundamental frequency of the fluid pulse source and frequency of the acoustic telemetry transmitter, wherein the fluid pulse source and the shock sub are configured to operate as a first telemetry enhancement device, and wherein the acoustic telemetry transmitter is disposed between the first telemetry enhancement device and a second telemetry enhancement device which comprises a second fluid pulse source and a second shock sub.

8. The system of claim 7, wherein the acoustic telemetry transmitter is located closer to a bit attached to the drill string than the first telemetry enhancement device.

9. The system of claim 7, further comprising:

an acoustic telemetry repeater located between the acoustic telemetry receiver and the first telemetry enhancement device.

10. The system of claim 7, further comprising:

three or more instances of telemetry enhancement devices.

11. The system of claim 10, further comprising:

at least one acoustic telemetry repeater disposed between pairs of the telemetry enhancement devices.

12. The system of claim 7, wherein the controller is attached to the drill string at a position downhole in a borehole of the formation.

13. A processor-implemented method to execute on one or more processors that perform the method, comprising:

positioning a first telemetry enhancement device, which includes a first fluid pulse source and a first shock sub, above an acoustic telemetry transmitter, and positioning a second telemetry enhancement device, which includes a second fluid pulse source and a second shock sub below the acoustic telemetry transmitter;

operating at least one of the first and second fluid pulse sources using drilling fluid to excite vibrations in the respective first and second shock subs so as to increase axial vibration in a drill string to reduce static friction between the drill string and a formation surrounding the drill string, wherein the vibrations are excited at a fundamental frequency outside of an operational communications frequency range of an associated acoustic telemetry communications system; and controlling the associated acoustic telemetry communications system and the first and second fluid pulse sources, individually and in combination, including controlling adjustment of the fundamental frequency of each of the first and second fluid pulse sources and frequency of the acoustic telemetry transmitter to control increasing and decreasing of the axial vibration in the drill string.

14. The method of claim 13, wherein the operational communications frequency range is from about 400 cycles/second to about 5000 cycles/second.

15. The method of claim 13, further comprising:

receiving an indication of sticking associated with the drill string; and operating at least one of the first and second fluid pulse sources using the drilling fluid to excite the vibrations in the respective first and second shock subs responsive to receiving the indication.

16. The method of claim 13, wherein the fundamental frequency is approximately equal to a resonant frequency of at least one of the first and second shock subs.

17. The method of claim 13, further comprising:

monitoring signal path transmissibility using a sensor located between a measurement while drilling sub of the drill string and a closest one of the first and second telemetry enhancement devices to the measurement while drilling sub.

18. The method of claim 13, further comprising:

determining an approximate location of sticking in a horizontal location of the drill string, wherein the determining is performed by at least one of a computer-aided design program and a simulation program; and assembling at least one of the first and second telemetry enhancement devices at the location along the drill string.

19. The method of claim 13, further comprising:

operating two or more instances of telemetry enhancement devices in a preselected sequence.

* * * * *